US006633649B1

(12) United States Patent
Honnert et al.

(10) Patent No.: US 6,633,649 B1
(45) Date of Patent: Oct. 14, 2003

(54) QUICK RELEASE SPIDER CLAMP FOR LOUDSPEAKERS

(75) Inventors: Matthew L. Honnert, Carol Stream, IL (US); Anthony J. Valene, Carol Stream, IL (US); John E. Burgess, Arlington Heights, IL (US)

(73) Assignee: Alumapro, Inc., Huntley, IL (US)

( * ) Notice: Subject to any disclaimer, the term of this patent is extended or adjusted under 35 U.S.C. 154(b) by 0 days.

(21) Appl. No.: 09/487,451

(22) Filed: Jan. 19, 2000

(51) Int. Cl.[7] ..... H04R 25/00

(52) U.S. Cl. ..... 381/404; 381/403; 381/409

(58) Field of Search ..... 381/403, 404, 381/409, 410, 400, 401, 394, 433, 405, 386, 395; 29/594

(56) References Cited

U.S. PATENT DOCUMENTS 5,850,462 A * 12/1998 Sakamoto ..... 381/404

* cited by examiner

*Primary Examiner*—Huyen Le
(74) *Attorney, Agent, or Firm*—Cook,Alex,McFarron,Manzo,Cummings & Mehler, Ltd.

(57) ABSTRACT

A loudspeaker has voice coil suspended in the gap of a frame and motor by a spider and cone. The spider is attached to the frame by a clamp. The frame has a pair of contact pads formed therein. First and second retainers on the frame and clamp are releasably engageable through a combined axial and rotational movement. The clamp when engaged holds the periphery of the spider against the frame and the leads of the voice coil against the contacts pads. Cam surfaces on the retainers create axial pressure to hold the spider against the frame.

26 Claims, 4 Drawing Sheets

QUICK RELEASE SPIDER CLAMP FOR LOUDSPEAKERS

BACKGROUND OF THE INVENTION

This invention relates to loudspeakers and is particularly concerned with a loudspeaker construction that permits field servicing in the form of a simple replacement of the entire voice coil, spider, cone and surround assembly. The invention is particularly applicable to woofers, although it is not limited thereto.

A typical loudspeaker includes a magnet assembly or motor attached to a basket or frame. The frame and motor define a gap in which a voice coil is disposed. The voice coil is suspended by a spider and cone/surround, both of which are attached to the frame. The electrical leads of the voice coil are connected to terminals on the frame. In the traditional loudspeaker the periphery of the spider is glued to the frame. The cone is attached to the frame by a flexible ring known as a surround. The electrical leads are permanently attached to the terminals, either by soldering or crimping.

The combination of the voice coil, spider, cone and surround is referred to herein as the active assembly. If the active assembly becomes damaged in a conventional loudspeaker, it must be removed from the frame and motor with mechanical cutting and solvents. A replacement assembly must then be installed in a series of steps including the following. The voice coil is aligned and bonded to the spider. The spider is aligned and bonded to the frame. The cone is aligned and bonded to the combination of the voice coil and spider. The surround is attached to the cone and then bonded to the frame. The leads from the voice coil must also be soldered to tinsels, which in turn must be soldered or crimped to the speaker terminals. Various tools, adhesives and solder are necessary to complete this procedure.

Very often field service technicians are unable or unwilling to undertake this laborious process. As a result many loudspeakers with damaged active assemblies are not repaired but simply discarded in their entirety, even though the frame and motor are undamaged and in perfectly usable condition. Even in instances where repairs are attempted, doing so necessitates returning the entire unit to the factory or service center with the attendant delay and expense.

SUMMARY OF THE INVENTION

This invention relates to a loudspeaker construction that makes replacement of the active assembly a simple procedure which can be readily performed in the field. Blown or damaged loudspeakers do not need to be returned to a factory or service center, as they can easily be repaired at a dealer's location in minutes with simple tools. In addition, loudspeakers of the present invention can be changed to new colors or other cosmetics with no difficulty.

The loudspeaker of the present invention has a basket or frame attached to a conventional magnet assembly which defines a gap for a voice coil. The voice coil is suspended by a spider and cone. The cone is attached to the frame by a surround. The surround is removably connected to the frame. The spider is also removably connected to the frame by a clamp. The frame has at least one first retainer fixed thereto. The clamp has a second retainer incorporated therein. The clamp is preferably a circular ring that can be disconnected from the frame for axial movement relative to the frame. Thus, the first and second retainers are also axially movable relative to one another. The retainers can move between a released position and an adjacent position.

When the first and second retainers are placed in the adjacent position, they can be rotated relative to one another so that they become engaged and prevent any relative axial movement. One of the retainers has a cam surface which engages the other retainer to apply axial pressure on the spider. The electrical connections to the voice coil are secured by this pressure onto contact pads which are electrically connected to the terminals. No soldering or crimping is required. Removal of the active assembly entails disconnecting the surround from the frame and rotating the clamp so the retainers are in the adjacent position. Then an axial movement of the clamp to its release position frees the spider and leads from the frame. The entire active assembly (plus the clamp) can then be removed from the frame.

DETAILED DESCRIPTION OF THE INVENTION

Figure 1:
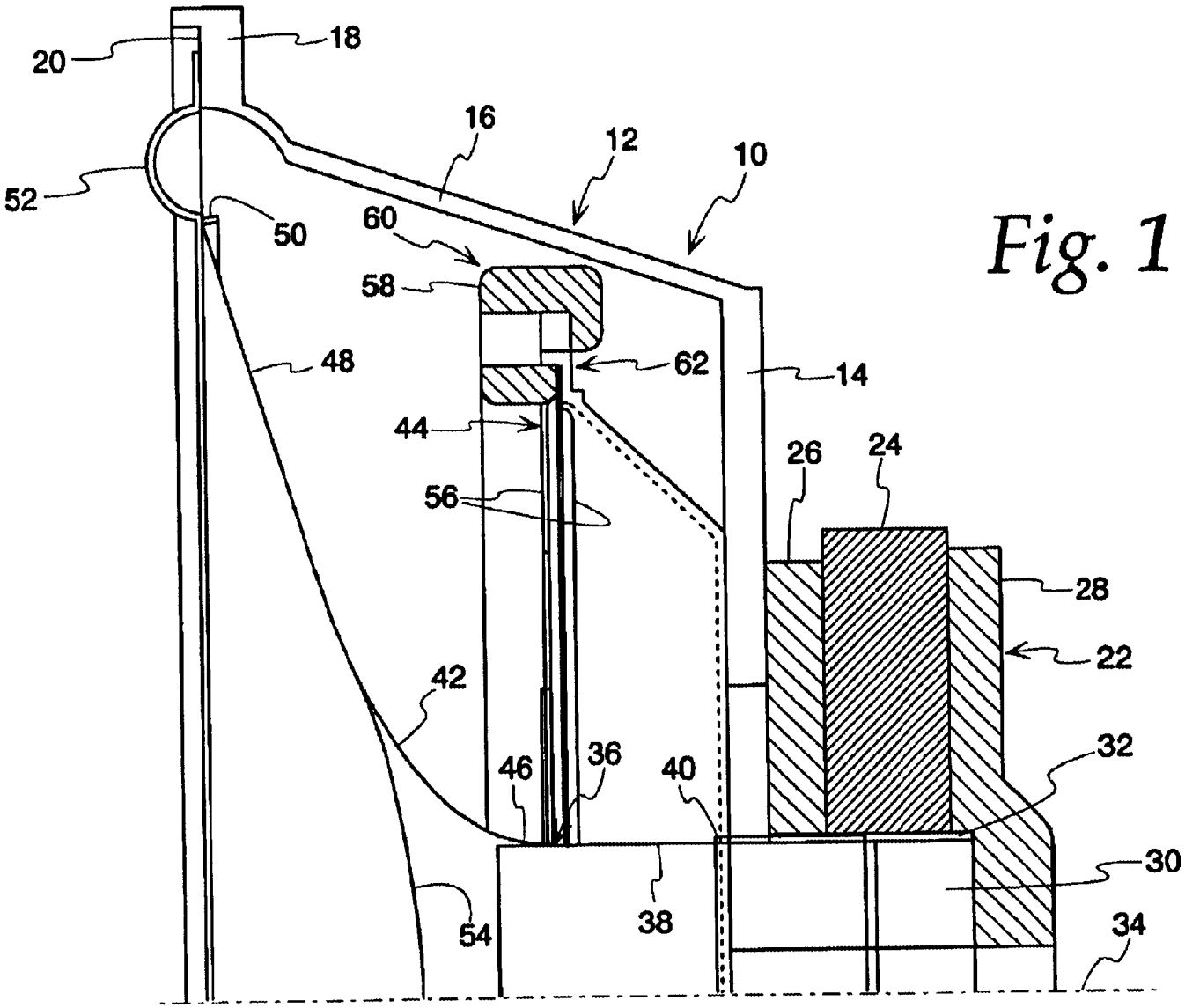
FIG. 1 is a longitudinal section through one half of a loudspeaker according to the invention.

The loudspeaker of the present invention is shown generally at 10 in FIG. 1. A frame 12 has a central base portion 14 and a plurality of spaced-apart legs 16 extending from the base 14 to an annular ring 18. The ring may have a groove 20 on its front surface for mounting a surround as will be described below.

The base 14 of the frame mounts a magnet assembly or motor 22. The motor includes a permanent magnet 24 sandwiched between a steel top plate 26 and a steel back plate 28. The motor further includes a center pole 30 attached to the back plate 28. The space between the center pole and the motor defines a gap 32. Together the frame 12 and motor 22 define a central axis 34. A voice coil 36 includes a cylindrical former 38 and a winding 40 wrapped around the former. One end of the voice coil and winding extends into the gap 32. The voice coil is suspended for axial movement by a cone 42 and a spider 44.

The cone 42 includes a central flange portion 46 which merges into a generally conical body section 48. The body section terminates at an outer peripheral edge 50. The edge 50 is attached to a surround 52. The surround is a flexible ring, typically made of rubber, which may be glued to the cone's periphery 50. The outer edge of the surround is releasably mounted in the groove 20 of the frame ring 18. The surround may be screwed, clamped or otherwise releasably attached to the ring. For example, a flat metal ring may be screwed into the frame ring 18 with the outer edge of the surround 52 clamped between the metal ring and the groove 20. The flange 46 of the cone is bonded to the former 38 by a suitable adhesive. A dust cap 54 may be glued to the body portion 48 of the cone to close off the central opening of the cone and to protect the voice coil 36.

Figure 8:
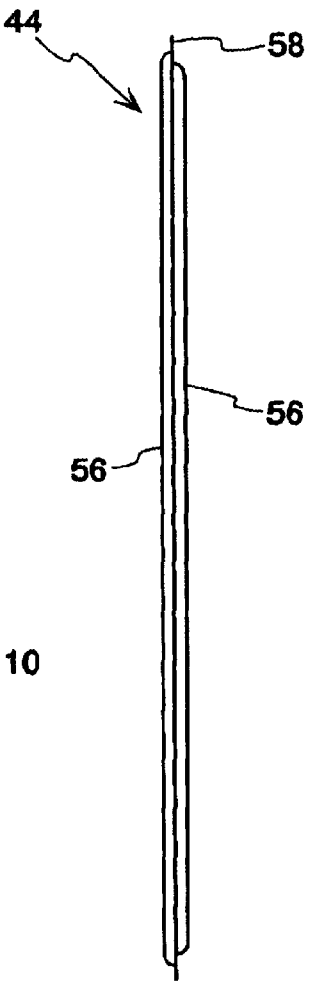
FIG. 8 is a side elevation view of the spider.
Figure 7:
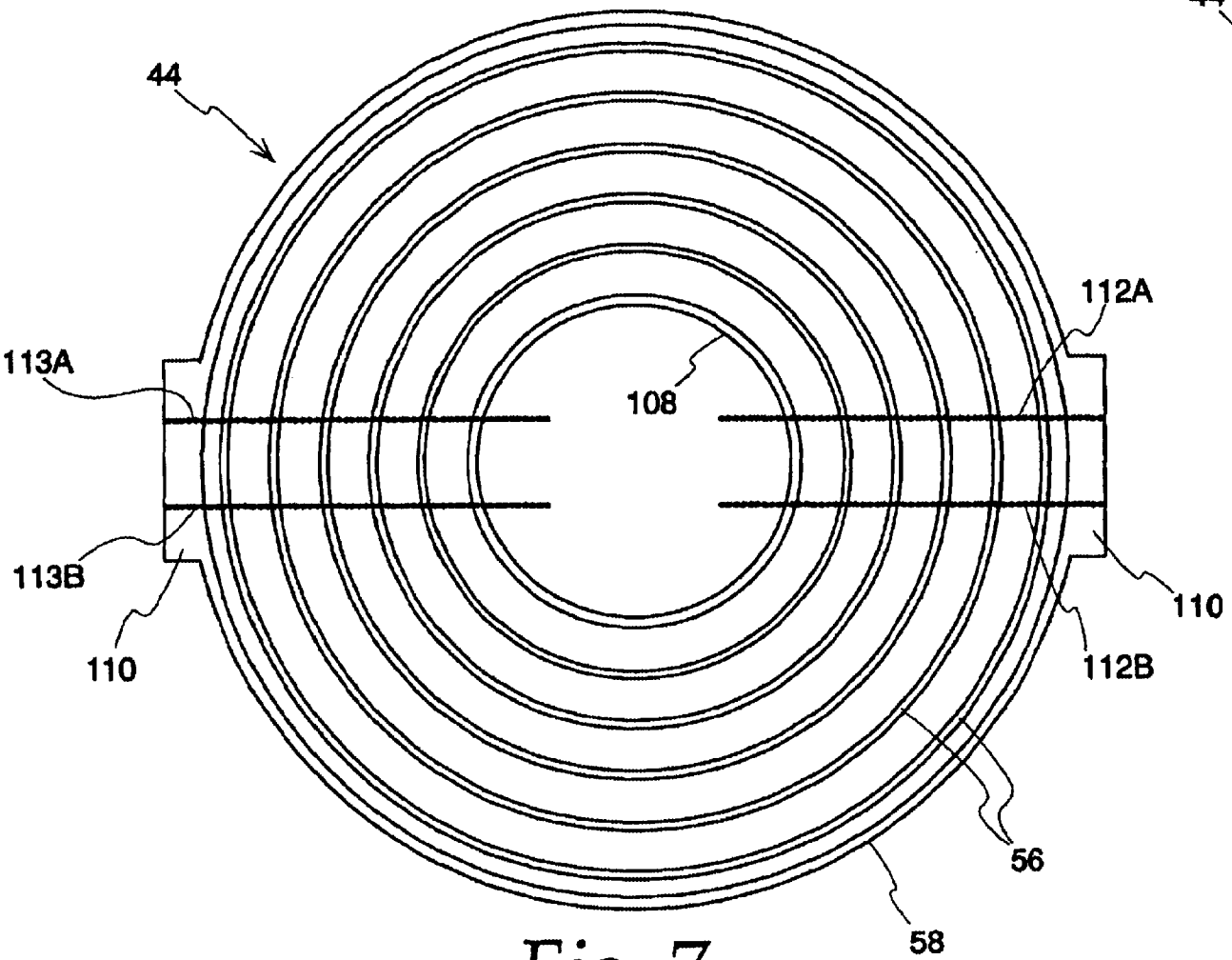
FIG. 7 is a plan view of the spider of the present invention.

The spider 44 is a flexible, woven member having a plurality of concentric, circular ribs or corrugations as shown at 56 in FIGS. 7 and 8. The spider terminates at an outer periphery 58. Typically, the spider is glued to the former. Further details of the spider are described below. It can be seen that together the cone 42 and spider 44 provide a flexible mounting for the voice coil 36.

Figure 3:
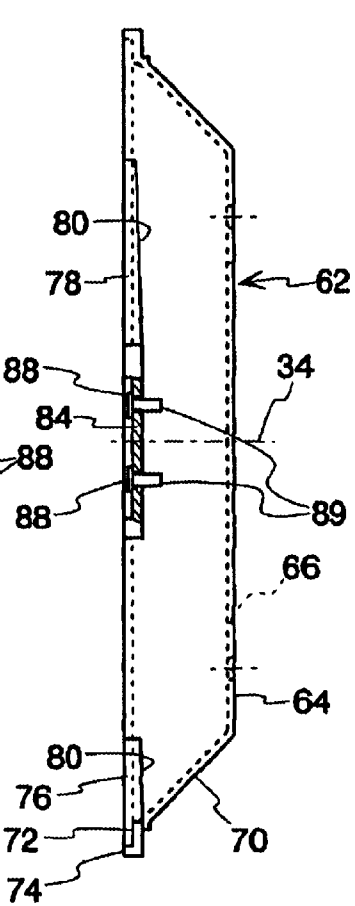
FIG. 3 is a side elevation view of the basket insert.
Figure 2:
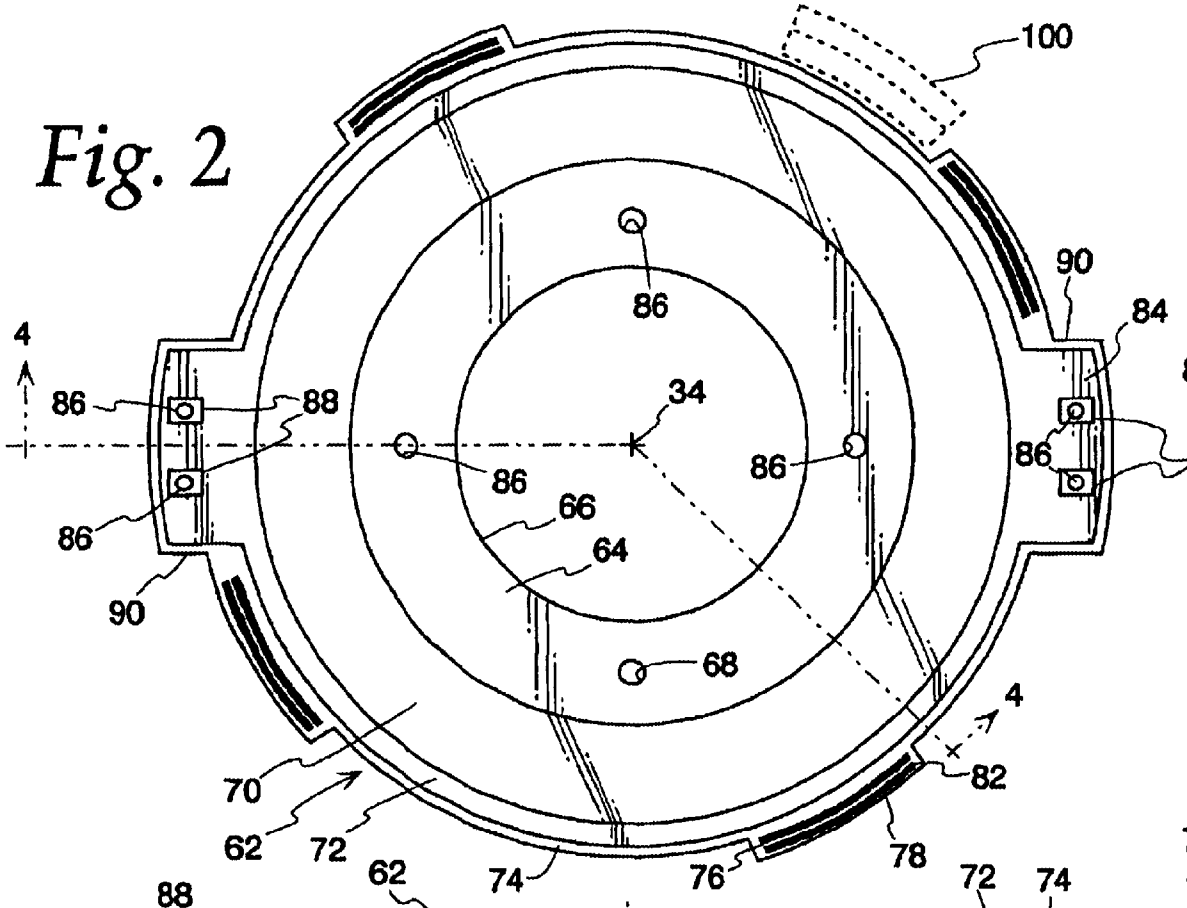
FIG. 2 is a top plan view of the basket insert.
Figure 4:
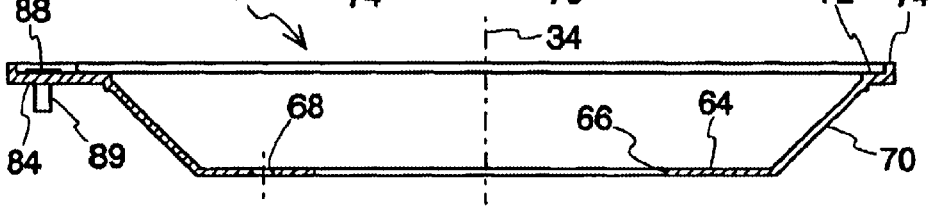
FIG. 4 is a section taken along line 4—4 of FIG. 2.

The spider 44 is releasably connected to the frame by a clamp 60 and basket insert 62. The basket insert is shown in detail in FIGS. 2–4. It has a flat, circular base 64 with a central opening 66 through which the voice coil extends. The base has a plurality of holes 68 through which bolts may extend for attaching the basket insert 62 to the frame's base portion 14. A conical wall 70 extends upwardly from the base 64. Wall 70 terminates at a rim which includes a top land 72 and an upstanding bead 74. As best seen in FIG. 4, the top land 72 is generally parallel to the base 64.

The rim of the basket insert also includes at least one first retainer 76. In the illustrated embodiment there are four such first retainers. They each comprise a tab which extends outwardly from the bead 74 and terminates at a free edge 78. The free edge is located a first distance from the central axis 34. The upper surface of the tab defines a radial first plane. The thickness of the tab varies along its arcuate extent due to a cam surface 80 on the underside of the tab. The cam surface of the tab may be ratcheted as shown diagrammatically at 82 in FIG. 2. The ratchets are small, upraised ridges or teeth that are somewhat flexible and engage a portion of the clamp to resist relative rotation of the clamp and basket insert.

The basket insert further includes a pair of ledges 84. These ledges extend or protrude beyond the diameter of the land 72. The ledges 84 are preferably on diametrically opposite sides of the basket. The bead 74 extends about the outer edges of the ledges as shown. The ledges include openings 86 for mounting a pair of electrical terminals 89. Openings 86 are surrounded by electrically conductive contact pads 88 which are in electrical engagement with the terminals 89 extending through openings 86. Preferably, the basket insert is made of a non-conductive, synthetic resinous plastic material such as Delrin®, a trademark of E. I. Du Pont de Nemours and Company. Accordingly, each associated terminal 89 and contact pad is electrically isolated from the other. It will be noted that the ledges 84 adjoin a first retainer tab 76. As such, the ledges provide a stop surface 90 which limits rotational movement of the clamp 60 as will be explained below.

Figure 5:
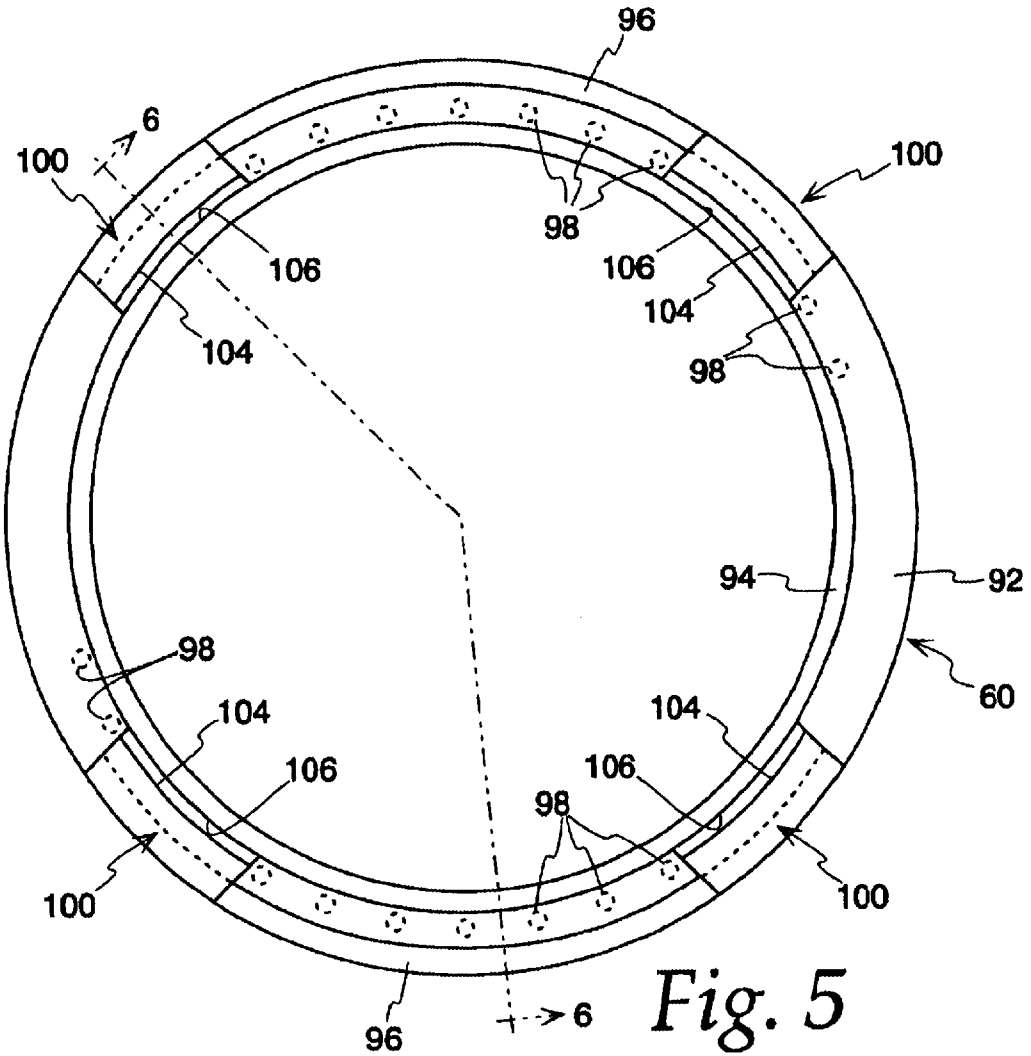
FIG. 5 is a plan view of the clamp.
Figure 6:
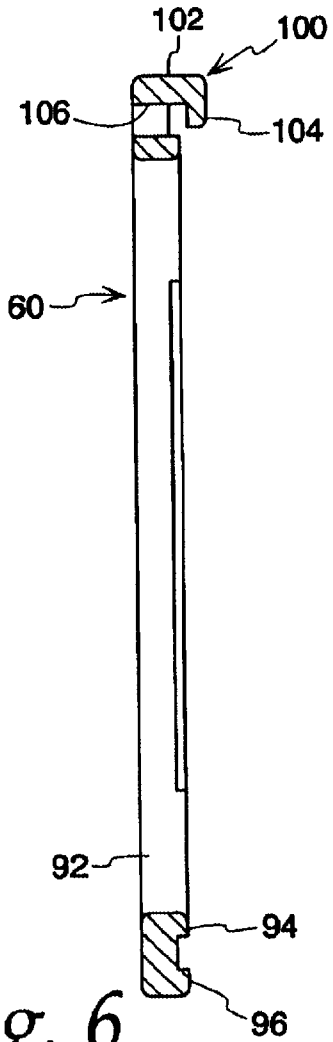
FIG. 6 is a section taken along line 6—6 of FIG. 5.

Turning now to FIGS. 5 and 6, details of the clamp 60 are illustrated. Preferably the clamp is made of non-conductive, synthetic resinous plastic material. The clamp has an annular body member 92 with an upstanding shoulder 94 extending all the way around the interior diameter of the body 92. There are also two outer partial shoulders 96 which extend on the outside diameter of the body member but only for a portion of the circumference. A series of circular depressions or receptacles 98 are formed in the body member. Most of these are between the shoulders 94 and 96, although two such depression are beyond the outer shoulder on each side of the body. The depressions 98 extend only partially through the thickness of the body member 92. They are for receiving the lugs of a tool or wrench which is used for applying opening or closing torque to the clamp.

Spaced about the circumference of the clamp 60 are four second retainers 100. Each retainer includes an axial leg 102 and a radial foot 104. The foot 104 defines a radial second plane. To facilitate molding of the leg and foot of the second retainer, a slot 106 is formed all the way through the body member 92 for the arcuate extent of the retainer. The inside diameter of the leg 102 is slightly greater than the first distance defined by the radius of the free edge 78 on the basket insert. The leg extends an axial distance sufficient to span the first plane defined by tabs 76 when the clamp is placed adjacent the basket insert. Thus, the second plane defined by the foot 104 will be axially spaced from the first plane defined by the tab 76. In other words, the foot will end up underneath the tab when the clamp is fixed to the basket insert.

FIGS. 7 and 8 show further details of the spider 44. In addition to the corrugations 56 and periphery 58, the spider has a central opening 108 that accommodates the voice coil former 38. The periphery 58 has a pair of extensions 110 centered on a diameter of the spider. The extensions are sized to fit onto the ledges 84 of the basket insert, just within the bead 74. Thus, the bead and extensions 110 cooperate to fix the orientation of the spider with respect to the basket insert. The spider also has a set of conductive tinsels 112A and 112B. The tinsels are woven into the spider and extend out into the opening 108 for connection to the electrical leads of the coil. The outer ends of the tinsels 112 extend on to the extension 110 and are folded back about the free edge of the extension. This forms loops that extend approximately ¼" on to the back side of the extension. This places the loops in position for being pressed into contact with the contact pads 88 of the basket insert. A second pair of tinsels is shown at 113A, 113B. The second pair may be used with voice coils having dual windings.

The use, operation and function of the invention are as follows. The loud-speaker is assembled by bolting together the basket insert 62, the frame base 14 and the magnet assembly or motor 22. The bolts extend through holes 68 to attach the basket insert. The active assembly is prepared as a separate sub-assembly and includes the voice coil 36, the cone 42, the surround 50, the dust cap 54 and the spider 44. The clamp 60 is placed loosely between the spider and the cone. The combination of the clamp and active assembly is then placed into the frame with the voice coil extending at least partially into the gap 32. When the active assembly is fully inserted, the periphery 58 of the spider will engage the land 72 of the basket insert with the extensions 110 fitting onto the ledges 84. The tinsel loops will be adjacent the contact pads at this time.

The spider is then releasably fixed to the basket insert by locking the clamp. To lock or affix the clamp 60, the second retainers 100 must be placed in a first, spaced relative rotational orientation with respect to the first retainer tabs 76. One second retainer 100 is shown in phantom in the first rotational orientation in FIG. 2. In this rotational relationship between the clamp and insert, axial movement of the clamp is possible. Next, the clamp is moved axially toward the motor 22 until the shoulder 94 contacts the periphery 58 of the spider 44. It will be noted that when the shoulder 94 engages the land 72, the inside diameter of the bead 74 engages the outside diameter of the shoulder 94 to hold the basket insert and clamp in concentric relation. This axial position wherein the shoulder 94 contacts the spider will be referred to herein as an adjacent position.

To lock the clamp 60 in the adjacent position, the clamp must be, rotated to cause engagement of the first and second retainers. As viewed in FIG. 2, this would entail a clockwise movement of the clamp relative to the stationary basket insert. Rotation of the clamp from the first, spaced relative rotational orientation to a second, aligned relative rotational orientation causes the feet 104 of the retainers 100 to engage the cam surfaces 80 of the tabs 76. The feet and tabs will engage because when the clamp is placed in the adjacent axial position, the feet 104 are in a second axial plane which is slightly spaced from the first axial plane defined by the tabs 76. That spacing reduces as continued rotation brings the cam surfaces into engagement with the feet. That engagement will cause an axial compression of the clamp against the spider periphery and against the basket insert. This same axial compression will press the loops of the traces 112 against the contact pads 88 and create a solid electrical connection to the terminals. The ratchets 82 will also engage the underside of the feet to help lock the retainers together. Rotation of the clamp is limited by engagement of the side edge of two second retainers 100 with the stop surfaces 90 of ledges 84.

Sufficient torque may be applied to the clamp 60 by use of a pair of suitable tools, each being in the nature of a wrench. Each tool has an elongated flat handle with a pair of prongs or lugs extending at right angles to the handle. The lugs are sized and spaced to fit into the depressions 98 in the clamp body member 92. The wrenches are passed between the frame legs 16 to the interior of the frame. With the aid of the wrenches on opposite sides of the clamp, it is possible to apply sufficient torque to firmly lock or set the second retainers in engagement with the first retainers in the second, aligned relative rotational orientation.

Removal of the active assembly can be achieved by basically reversing the steps described above. The clamp 60 is rotated from the second, aligned relative rotational orientation to the first, spaced relative rotational orientation which will release the second retainers 100 from the first retainers 76. Then the clamp can be axially moved relative to the basket insert to a release position. Removal of the connection of the surround 52 to the frame ring 18 will then free the active assembly and permit it to be taken out of the frame.

It will be noted that locking and unlocking the clamp simultaneously takes care of both the electrical connections of the traces and the mechanical connection of the spider. Furthermore, the spider extension and ledge combination assures proper orientation of the spider while the bead assures proper alignment of the voice coil in the gap.

While a preferred form of the invention has been shown and described, it will be realized that alterations and modifications may be made thereto without departing from the scope of the following claims. For example, while the first retainer is shown incorporated in the basket insert which is separate from the frame, some or all of the components of the basket insert could be integrally formed in the frame base. Thus, the first retainer might be molded into the frame base. Clearly, if the contact pads 88 were incorporated in the frame base, proper electrical isolation from the metal frame parts would be required.

What is claimed is:

1. A loudspeaker, comprising:

a frame including at least one first retainer fixed thereto;

a motor attached to the frame, the motor and frame defining a gap and an axis;

a voice coil disposed partially in the gap;

a spider connected to the voice coil;

a cone connected to the voice coil;

a surround connected to the cone and attached to the frame; and a clamp having at least one second retainer formed thereon, the first and second retainers being axially movable relative to one another between a released position and an adjacent position when the retainers are arranged in a first, spaced relative rotational orientation, and the first and second retainers when in the adjacent position being rotationally movable about said axis between said first, spaced relative rotational orientation and a second, aligned relative rotational orientation wherein the retainers engage one another to prevent relative axial movement between them, the clamp at least when in said second relative rotational orientation engaging at least a portion of the periphery of the spider to removably attach the spider to the frame.

2. The loudspeaker of claim 1 wherein the first retainer comprises at least one tab having a free edge a first distance from the axis, the tab defining a first plane, and the second retainer comprises a hook having an axial leg and a radial foot, the leg being arranged generally perpendicular to said first plane and, when the retainers are the adjacent position, the leg at least partially spans said first plane at a distance from the axis that is slightly more than said first distance, and the radial foot extending from the leg toward the axis in a second plane axially spaced from the first plane such that the foot overlies the tab when the retainers are in said second, aligned relative rotational orientation.

3. The loudspeaker of claim 2 wherein the tab has a thickness that is variable.

4. The loudspeaker of claim 2 wherein the tab and foot will engage in an interference fit when the retainers are in said second, aligned relative rotational orientation.

5. The loudspeaker of claim 2 wherein the tab has a thickness that is variable and will cause the tab and foot to engage in an interference fit when the retainers are moved toward said second, aligned relative rotational orientation.

6. The loudspeaker of claim 1 further comprising a ledge fixed to the frame and engageable with the second retainer to form a rotational stop.

7. The loudspeaker of claim 6 wherein the voice coil further comprises a pair of electrical leads extending therefrom and the ledge further comprises a pair of electrical terminals attached thereto, and a pair of conductive contact pads in electrical connection with said terminals but electrically insulated from the frame, the electrical leads being held in electrical engagement with said contact pads by the clamp when the retainers are in said second, aligned relative rotational orientation.

8. The loudspeaker of claim 7 wherein the electrical leads have loops formed at their ends in engagement with the contact pads.

9. The loudspeaker of claim 1 wherein the voice coil further comprises a pair of electrical leads extending therefrom and the frame further comprises a pair of electrical terminals attached thereto, and a pair of conductive contact pads in electrical connection with said terminals but electrically insulated from the frame, the electrical leads being held in electrical engagement with said contact pads by the clamp when the retainers are in said second, aligned relative rotational orientation.

10. The loudspeaker of claim 9 wherein the electrical leads have loops formed at their ends in engagement with the contact pads.

11. The loudspeaker of claim 1 further comprising a ledge fixed to the frame and having a bead formed around the edges of the ledge, the spider further comprising an extension portion overlying the ledge within said bead for orienting the spider.

12. The loudspeaker of claim 1 wherein at least one of the retainers has a cam surface engageable with the other retainer to effect axial movement and create pressure between the clamp and frame when the retainers are moved toward said second, aligned relative rotational orientation.

13. The loudspeaker of claim 1 wherein the frame further comprises a basket insert having a generally flat, circular base fixedly attached to the frame concentric with said axis, a conical wall extending out of the plane of the base and terminating at a rim which includes a land parallel to the base.

14. The loudspeaker of claim 13 wherein the first retainer comprises at least one tab extending from the land to a free edge a first distance from the axis, the tab defining a first plane, and the second retainer comprises a hook having an axial leg and a radial foot, the leg being arranged generally perpendicular to said first plane and, when the retainers are the adjacent position, the leg at least partially spans said first plane at a distance from the axis that is slightly more than said first distance, and the radial foot extending from the leg toward the axis in a second plane axially spaced from the first plane such that the foot overlies the tab when the retainers are in said second, aligned relative rotational orientation.

15. The loudspeaker of claim 13 further comprising a ledge extending from the land and engageable with the second retainer to form a rotational stop.

16. The loudspeaker of claim 15 wherein the voice coil further comprises a pair of electrical leads extending therefrom and the ledge further comprises a pair of electrical terminals attached thereto, and a pair of conductive contact pads in electrical connection with said terminals but electrically insulated from the frame, the electrical leads being held in electrical engagement with said contact pads by the clamp when the retainers are in said second, aligned relative rotational orientation.

17. The loudspeaker of claim 16 wherein the electrical leads have loops formed at their ends in engagement with the contact pads.

18. The loudspeaker of claim 13 further comprising a ledge extending from the land and having a bead formed around the edges of the ledge, the spider further comprising an extension portion overlying the ledge within said bead for orienting the spider.

19. The loudspeaker of claim 13 wherein the basket insert is made of electrically non-conductive material and wherein the voice coil further comprises a pair of electrical leads extending therefrom and the land further comprises a pair of electrical terminals attached thereto, and a pair of conductive contact pads in electrical connection with said terminals, the electrical leads being held in electrical engagement with said contact pads by the clamp when the retainers are in said second, aligned relative rotational orientation.

20. A loudspeaker, comprising:

a frame including a pair of terminals attached thereto and a pair of contact pads in electrical engagement with the terminals;

a motor attached to the frame, the motor and frame defining a gap and an axis;

a voice coil disposed partially in the gap and including a pair of electrical leads;

a spider connected to the voice coil;

a cone connected to the voice coil;

a surround connected to the cone and attached to the frame; and a clamp removably engageable with the frame and at least a portion of the periphery of the spider and with the electrical leads to removably fix the spider to the frame and the electrical leads to the contact pads.

21. The loudspeaker of claim 20 wherein the electrical leads have loops formed at their ends in engagement with the contact pads.

22. The loudspeaker of claim 20 wherein the electrical leads comprises traces woven into the spider.

23. The loudspeaker of claim 22 wherein the electrical leads have loops formed at their ends in engagement with the contact pads.

24. The loudspeaker of claim 20 further comprising a ledge fixed to the frame and having a bead formed around the edges of the ledge, the spider further comprising an extension portion overlying the ledge within said bead for orienting the spider.

25. The loudspeaker of claim 24 wherein the electrical leads comprises traces woven into the spider.

26. The loudspeaker of claim 25 wherein the electrical leads have loops formed at their ends in engagement with the contact pads.

* * * * *